US011371123B2

(12) United States Patent
Ohno et al.

(10) Patent No.: US 11,371,123 B2
(45) Date of Patent: Jun. 28, 2022

(54) LOW THERMAL EXPANSION ALLOY

(71) Applicant: SHINHOKOKU STEEL CORPORATION, Kawagoe (JP)

(72) Inventors: Haruyasu Ohno, Kawagoe (JP); Kotaro Ona, Kawagoe (JP); Naoki Sakaguchi, Kawagoe (JP)

(73) Assignee: SHINHOKOKU MATERIAL CORP., Kawagoe (JP)

( * ) Notice: Subject to any disclaimer, the term of this patent is extended or adjusted under 35 U.S.C. 154(b) by 101 days.

(21) Appl. No.: 16/621,873

(22) PCT Filed: Aug. 24, 2018

(86) PCT No.: PCT/JP2018/031447
§ 371 (c)(1),
(2) Date: Dec. 12, 2019

(87) PCT Pub. No.: WO2019/044721
PCT Pub. Date: Mar. 7, 2019

(65) Prior Publication Data

US 2021/0198773 A1 Jul. 1, 2021

(30) Foreign Application Priority Data

Sep. 1, 2017 (JP) ..... JP2017-168818

(51) Int. Cl.

| | |
|---|---|
| ***B32B 15/00*** | (2006.01) |
| ***C22C 38/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/105* (2013.01); *C22C 38/002* (2013.01); *C22C 38/005* (2013.01); *C22C 38/02* (2013.01); *C22C 38/04* (2013.01); *C22C 38/06* (2013.01)

(58) Field of Classification Search
None
See application file for complete search history.

(56) References Cited

U.S. PATENT DOCUMENTS 4,853,298 A * 8/1989 Harner ..... C22C 38/105 428/630
2002/0043306 A1* 4/2002 Cozar ..... H01J 29/07 148/336

FOREIGN PATENT DOCUMENTS

| | | | |
|---|---|---|---|
| JP | 55-6484 | A | 1/1980 |
| JP | 61-235535 | A | 10/1986 |
| JP | 1-191763 | A | 8/1989 |
| JP | 10-310845 | A | 11/1998 |
| JP | 2000-119793 | A | 4/2000 |
| JP | 2001-11580 | A | 1/2001 |
| JP | 2001-192777 | A | 7/2001 |
| JP | 2003-221650 | A | 8/2003 |
| JP | 2014-101543 | A | 6/2014 |
| JP | 2016-11451 | A | 1/2016 |
| JP | 2016-27187 | A | 2/2016 |
| JP | 2016-27188 | A | 2/2016 |
| JP | 2017-145456 | A | 8/2017 |

OTHER PUBLICATIONS

International Preliminary Report on Patentability and Written Opinion of the International Searching Authority (Forms PCT/IB/373 and PCT/ISA/237), dated Mar. 3, 2020, for International Application No. PCT/JP2018/031447, with an English translation.
International Search Report (Form PCT/ISA/210), dated Oct. 30, 2018, for International Application No. PCT/JP2018/031447, with an English translation.
Japanese Office Action, dated Dec. 25, 2019, for corresponding Japanese Application No. 2018-566331, with an English translation.

* cited by examiner

*Primary Examiner* — Seth Dumbris
(74) *Attorney, Agent, or Firm* — Birch, Stewart, Kolasch & Birch, LLP

(57) ABSTRACT

Provided is a low thermal expansion alloy wherein martensitic transformation does not occur even at −120° C. This low thermal expansion alloy contains, in mass %, 1.50-5.00% of Co, while containing Ni in such an amount that if [Ni] (mass %) is the content of Ni and [Co] (mass %) is the content of Co, $[Co] \geq -4\times[Ni]+136$ and $[Co] \leq -4\times[Ni]+139$ are satisfied, with the balance being made up of Fe and unavoidable impurities. This low thermal expansion alloy has an average thermal expansion coefficient of $0.5\times10^{-6}$/° C. or less for the range of 0-30° C., while having a martensitic transformation temperature of −120° C. or less.

3 Claims, No Drawings

LOW THERMAL EXPANSION ALLOY

FIELD

The present invention relates to a low thermal expansion alloy, in particular relates to a low thermal expansion alloy which, when used in a low temperature region or when exposed to a low temperature, is prevented from transformation and thereby is inhibited in deformation affecting precision at precision instruments etc.

BACKGROUND

The thermally stable Invar alloy is being widely used as a material for components of electronics, semiconductor related equipment, laser machines, and ultra precision machines. In particular, 32% Ni-5% Co—Fe ("%" means "mass %", same below) alloys referred to as so-called "Super Invar Alloys" are being used. The mean thermal expansion coefficient of 32% Ni-5% Co—Fe alloy is an extremely low $1\times10^{-6}$/° C. or less.

Furthermore, due to diversification of environments of use and transport routes, use with a stable precision in a low temperature region by measures against lower temperatures due to use in cold regions and temporary exposure to low temperatures during transport is strongly desired in a low thermal expansion alloy.

PTL 1 discloses a low temperature stable type low thermal expansion alloy excellent in machinability. The low thermal expansion alloy disclosed in PTL 1 contains, by wt %, C: 0.05% or less, Si: 0.35% or less, Mn: 0.35% or less, P: 0.01% or less, S: 0.015 to 0.030%, Ni: 30.0 to 35.0%, and Co: 2.0 to 6.5%, suitably adjusts the contents of Ni, Co, and S, and prevents martensite transformation in the −20° C. or more temperature region.

PTL 2 discloses a low thermal expansion casting containing, by wt %, C: 0.2 to 0.8%, Si: 0.1 to 0.5%, Mn: 0.2 to 0.7%, Ni: 26 to 30%, Co: 6 to 9%, Ni+Co: 34 to 37%, and Cu: 0.2 to 1.0% and subjected to homogenization annealing at a temperature of 850° C. or less so that a linear thermal expansion coefficient at ordinary temperature to 200° C. becomes $1.5\times10^{-6}$/° C. or less, almost no heat treatment deformation occurs, and the martensite transformation starting point becomes −50° C. or less.

PTL 3 discloses a low temperature stable type Ni—Co—Fe-based low thermal expansion alloy containing, by wt %, Ni: 30.0 to 34.0% and Co: 4.5 to 6.5%, having an $X_T$: (% Co)+2.8 (% Ni) found from the contents of Ni and Co so that martensite transformation does not occur in a predetermined temperature region, adjusting the constituents so that $X_T$ satisfies $93\leq\{X_T=(\%\ Co)+2.8(\%\ Ni)\}\leq99$, inhibiting martensite transformation at a low temperature, and having a thermal expansion coefficient of $1.0\times10^{-6}$/° C. or less.

[CITATIONS LIST]

PATENT LITERATURE

[PTL 1] Japanese Unexamined Patent Publication No. 2003-221650

[PTL 2] Japanese Unexamined Patent Publication No. 2001-192777

[PTL 3] Japanese Unexamined Patent Publication No. 2001-11580

SUMMARY

Technical Problem

In recent years, due to applications such as scientific satellites, low temperature stability at a low temperature such as −120° C. is being demanded from low thermal expansion alloys.

The objective in this invention is to provide a low thermal expansion alloy with stable austenitic structure at the temperature down to −120° C.

Solution to Problem

The inventors intensively studied a low thermal expansion alloy with stable austenitic structure. Steel undergoes martensite transformation if the temperature becomes lower. In a low thermal expansion alloy, the martensite transformation temperature is usually 0° C. or less, but if martensite transformation occurs, remarkable expansion occurs and members deteriorate in dimensional precision and low thermal expansion characteristic.

The inventors discovered as a result of their studies that by limiting the contents of Ni and Co and furthermore limiting the relationship of the contents of these two elements, it is possible to lower the martensite transformation temperature and obtain a stable microstructure with no martensite transformation even at −120° C.

The present invention was made based on the above discovery and has as its gist the following:

(1) A low thermal expansion alloy containing, by mass %, Co: 1.50 to 5.00%, Ni satisfying $[Co]\geq-4\times[Ni]+136$ and $[Co]\geq-4\times[Ni]+139$ wherein [Ni] (mass %) is a content of Ni and [Co] (mass %) is a content of Co, and a balance of Fe and unavoidable impurities, wherein a mean thermal expansion coefficient at 0 to 30° C. is $0.5\times10^{-6}$/° C. or less and a martensite transformation temperature is −120° C. or less.

(2) The low thermal expansion alloy according to (1), containing, instead of part of the Fe, by mass %, one or more of C: 0 to 0.040%, Si: 0 to 0.30%, Mn: 0 to 0.50%, Al: 0 to 0.20%, Mg: 0 to 0.100%, Ca: 0 to 0.100%, Ce: 0 to 0.100%, and La: 0 to 0.100%.

Advantageous Effects of Invention

According to the present invention, a low thermal expansion alloy with stable austenitic structure at the temperature down to −120° C. is obtained, so the invention can be applied to members used in low temperature regions lower than in the past.

DESCRIPTION OF EMBODIMENTS

Below, the present invention will be explained in detail. Below, the "%" relating to the chemical composition will mean "mass %" unless indicated otherwise. First, the chemical composition of the low thermal expansion alloy of the present invention will be explained.

Co is an essential element for lowering the thermal expansion coefficient. To make the thermal expansion coefficient a desired range, the content of Co is made 1.50 to 5.00%. To obtain a lower thermal expansion coefficient, preferably the content is made 2.50 to 4.50%.

The low thermal expansion alloy of the present invention may further contain the following constituents. The elements other than Co are not essential. The contents may also be 0.

C forms a solid solution in austenite and contributes to improvement of the strength. If the content of C becomes greater, the thermal expansion coefficient becomes larger. Furthermore, the ductility falls and casting cracks easily occur, so the content is made 0.040% or less, preferably 0.010% or less.

Si is added as a deoxidizer. If the amount of Si exceeds 0.30%, the thermal expansion coefficient increases, so the amount of Si is made 0.30% or less, preferably 0.10% or less. To improve the fluidity of the melt at the time of casting, Si is preferably included in 0.05% or more.

Mn is added as a deoxidizer. Further, it also contributes to improvement of strength by solid solution strengthening. If the content of Mn is too great, the thermal expansion coefficient becomes higher, so the amount of Mn is 0.50% or less, preferably 0.20% or less.

Ni is an essential element for lowering the thermal expansion coefficient. In the low temperature stability type low thermal expansion alloy of the present invention, to lower the martensite transformation temperature and obtain a stable microstructure with stable austenitic structure even at −120° C., the balance of the amount of Ni and the amount of Co is important. Specifically, when [Ni] (mass %) is a content of Ni and [Co] (mass %) is a content of Co, it is necessary to include Ni satisfying $[Co] \geq -4\times[Ni]+136$ and $[Co] \leq -4\times[Ni]+139$. For example, when the amount of Co is 3.00%, the content of Ni is made 33.25 to 34.00%. By limiting Ni to a restricted range in this way, it is possible to obtain a microstructure stable at low temperature. To obtain a lower thermal expansion coefficient, preferably $[Co] \geq -4\times[Ni]+136$, and $[Co] \leq -4\times[Ni]+138$.

Al is added for the purpose of deoxidation. Further, to keep inclusions from forming, reduce casting defects, and obtain a further lower thermal expansion coefficient, the content is made 0 to 0.20%.

Mg bonds with S contained as an impurity and thereby has the function of keeping down grain boundary segregation of S and improving the hot ductility. The content of Mg is made 0 to 0.100%.

Ca bonds with S to form sulfides and is useful for improving the hot workability and improving the ductility at ordinary temperature. The content of Ca is made 0 to 0.100%.

Ce and La are elements suppressing a drop in ductility due to sulfides. The contents of Ce and La are respectively made 0 to 0.100%.

The balance of the chemical composition is comprised of Fe and unavoidable impurities. The "unavoidable impurities" are constituents which unavoidably enter from the raw materials, manufacturing environment, etc. when industrially manufacturing steel having the chemical composition prescribed in the present invention.

By producing an alloy having the above chemical composition by casting, it is possible to obtain a low thermal expansion alloy with stable austenitic structure even at a low temperature. The mold used when producing low thermal expansion alloy of the present invention, the apparatus for pouring the molten steel into the mold, and the pouring method are not particularly limited. Known apparatuses and methods may be used. It is possible to work the produced cast alloy by direct machining etc. or work it after forging to obtain a steel part.

The low temperature stability of the low thermal expansion alloy of the present invention can be confirmed by holding the alloy in a low temperature atmosphere and examining for any martensite transformed structures. For example, it is possible to use the method of using liquid nitrogen to hold a test piece in a −120° C. atmosphere for 15 minutes, then use an optical microscope to examine for any martensite transformed structures.

Furthermore, to lower the thermal expansion coefficient more, diffusion treatment or solid solution treatment may also be performed. The diffusion treatment is performed after casting in the case of a casting and before heating for forging or at an intermediate stage of forging in the case of a forging. The solid solution treatment is performed before working, that is, directly after casting or after casting and forging. The diffusion treatment holds a casting at 1100 to 1300° C. for 10 to 50 hr then air cools or furnace cools it. The solid solution treatment heats the alloy to preferably 600 to 1000° C., more preferably 650 to 850° C., holds it there for 0.5 to 5 hr, then rapidly cools it. The cooling rate is preferably 10° C./min or more, more preferably 100° C./min or more. Due to the solid solution treatment, precipitates formed at the time of casting or the time of forging form solid solutions whereby the ductility and toughness are improved.

The low thermal expansion alloy having the chemical composition of the present invention has a low thermal expansion coefficient with a mean thermal expansion coefficient at 0 to 30° C. of $0.5\times10^{-6}$/° C. or less and is free of martensite transformation at −120° C., that is, has a martensite transformation temperature of −120° C. or less. According to the present invention, furthermore, it is also possible to obtain a low thermal expansion alloy with a mean thermal expansion coefficient at 0 to 30° C. of $0.1\times10^{-6}$/° C. or less.

After the solid solution treatment, if necessary, it is also possible to perform stress-relieving annealing holding the steel at 300 to 350° C. for 1 to 5 hr, then air cooling or other known heat treatment.

EXAMPLES

A high frequency melting furnace was used to produce Y-blocks and ingots adjusted to have the chemical compositions shown in Table 1. After that, the Y-blocks were subjected to diffusion treatment and solid solution treatment to obtain castings and the ingots were subjected to diffusion treatment, hot forging, and solid solution treatment to obtain forgings. Test pieces for confirming martensite transformed structures and test pieces for measuring the thermal expansion coefficient were taken.

The martensite transformed structures were confirmed by using liquid nitrogen to hold a test piece in −100° C. and −120° C. atmospheres for 15 minutes, then using an optical microscope to examine for any martensite transformed structures. The results are shown in Table 1.

The low thermal expansion alloy of the present invention was low in thermal expansion coefficient and further was free from martensite transformed structures even at −120° C.

As opposed to this, in the comparative examples, martensite transformed structures are formed at −100° C. or the thermal expansion coefficient becomes higher. The targeted characteristic was not able to be obtained in at least one of the same.

TABLE 1

| Alloy no. | Class | Chemical constituents (%) C | Si | Mn | Ni | Co | Al | Mg | Ca | Ce | La | Diffusion treatment Temp. (° C.) | Time (Hr) | Formation of martensite transformed structures −100° C. | −120° C. | Thermal expansion coefficient α0 to 30° C. (ppm/° C.) | |
|---|---|---|---|---|---|---|---|---|---|---|---|---|---|---|---|---|---|
| 1 | Forging | — | — | — | 33.55 | 3.27 | — | — | — | — | — | 1250 | 50 | No | No | −0.32 | Inv. ex. |
| 1 | Casting | " | " | " | " | " | " | " | " | " | " | " | " | No | No | −0.26 | Inv. ex. |
| 2 | Forging | — | — | — | 33.74 | 1.69 | — | — | — | — | — | 1100 | 10 | No | No | 0.22 | Inv. ex. |
| 2 | Casting | " | " | " | " | " | " | " | " | " | " | " | " | No | No | 0.31 | Inv. ex. |
| 3 | Forging | — | — | — | 34.25 | 1.75 | — | — | — | — | — | — | — | No | No | 0.28 | Inv. ex. |
| 3 | Casting | " | " | " | " | " | " | " | " | " | " | " | " | No | No | 0.36 | Inv. ex. |
| 4 | Forging | — | — | — | 33.01 | 4.88 | — | — | — | — | — | 1150 | 25 | No | No | 0.19 | Inv. ex. |
| 4 | Casting | " | " | " | " | " | " | " | " | " | " | " | " | No | No | 0.27 | Inv. ex. |
| 5 | Forging | — | — | — | 33.48 | 4.79 | — | — | — | — | — | 1200 | 15 | No | No | 0.35 | Inv. ex. |
| 5 | Casting | " | " | " | " | " | " | " | " | " | " | " | " | No | No | 0.44 | Inv. ex. |
| 6 | Forging | 0.015 | 0.15 | 0.27 | 33.82 | 1.79 | 0.13 | 0.056 | 0.009 | 0.017 | 0.008 | 1200 | 25 | No | No | 0.34 | Inv. ex. |
| 6 | Casting | " | " | " | " | " | " | " | " | " | " | " | " | No | No | 0.39 | Inv. ex. |
| 7 | Forging | 0.003 | 0.09 | 0.08 | 33.70 | 3.05 | 0.05 | 0.024 | 0.007 | 0.022 | 0.012 | — | — | No | No | −0.05 | Inv. ex. |
| 7 | Casting | " | " | " | " | " | " | " | " | " | " | " | " | No | No | 0.04 | Inv. ex. |
| 8 | Forging | 0.007 | 0.08 | 0.08 | 33.31 | 3.00 | 0.09 | 0.032 | 0.010 | 0.025 | 0.014 | 1250 | 50 | No | No | −0.24 | Inv. ex. |
| 8 | Casting | " | " | " | " | " | " | " | " | " | " | " | " | No | No | −0.18 | Inv. ex. |
| 9 | Forging | 0.012 | 0.16 | 0.31 | 33.75 | 3.52 | 0.10 | 0.048 | 0.012 | 0.021 | 0.012 | — | — | No | No | 0.22 | Inv. ex. |
| 9 | Casting | " | " | " | " | " | " | " | " | " | " | " | " | No | No | 0.31 | Inv. ex. |
| 10 | Forging | 0.003 | 0.09 | 0.15 | 33.33 | 3.93 | 0.11 | 0.041 | 0.008 | 0.019 | 0.008 | 1150 | 50 | No | No | −0.04 | Inv. ex. |
| 10 | Casting | " | " | " | " | " | " | " | " | " | " | " | " | No | No | 0.03 | Inv. ex. |

TABLE 2

(Continuation of Table 1)

| Alloy no. | Class | Chemical constituents (%) C | Si | Mn | Ni | Co | Al | Mg | Ca | Ce | La | Diffusion treatment Temp. (° C.) | Time (Hr) | Occurrence of martensite transformed microstructure −100° C. | −120° C. | thermal expansion coefficient α0 to 30° C. (ppm/° C.) | |
|---|---|---|---|---|---|---|---|---|---|---|---|---|---|---|---|---|---|
| 11 | Forging | 0.025 | 0.24 | 0.25 | 33.15 | 4.88 | 0.08 | 0.066 | 0.007 | 0.026 | 0.014 | 1100 | 50 | No | No | 0.37 | Inv. ex. |
| 11 | Casting | " | " | " | " | " | " | " | " | " | " | " | " | No | No | 0.44 | Inv. ex. |
| 12 | Forging | 0.011 | 0.22 | 0.21 | 33.42 | 4.72 | 0.16 | 0.073 | 0.011 | 0.019 | 0.010 | 1300 | 10 | No | No | 0.12 | Inv. ex. |
| 12 | Casting | " | " | " | " | " | " | " | " | " | " | " | " | No | No | 0.15 | Inv. ex. |
| 13 | Forging | — | — | — | 32.66 | 5.11 | — | — | — | — | — | 1200 | 10 | Yes | — | 0.35 | Comp. ex. |
| 13 | Casting | " | " | " | " | " | " | " | " | " | " | " | " | Yes | — | 0.41 | Comp. ex. |
| 14 | Forging | — | — | — | 33.77 | 5.24 | — | — | — | — | — | — | — | No | No | 0.75 | Comp. ex. |
| 14 | Casting | " | " | " | " | " | " | " | " | " | " | " | " | No | No | 0.81 | Comp. ex. |
| 15 | Forging | — | — | — | 33.50 | 1.13 | — | — | — | — | — | — | — | Yes | — | 0.25 | Comp. ex. |
| 15 | Casting | " | " | " | " | " | " | " | " | " | " | " | " | Yes | — | 0.30 | Comp. ex. |
| 16 | Forging | — | — | — | 34.55 | 1.39 | — | — | — | — | — | 1150 | 50 | No | No | 0.55 | Comp. ex. |
| 16 | Casting | " | " | " | " | " | " | " | " | " | " | " | " | No | No | 0.59 | Comp. ex. |
| 17 | Forging | 0.003 | 0.35 | 0.27 | 33.68 | 4.51 | 0.07 | 0.067 | 0.013 | 0.029 | 0.016 | 1200 | 25 | No | No | 0.66 | Comp. ex. |
| 17 | Casting | " | " | " | " | " | " | " | " | " | " | " | " | No | No | 0.75 | Comp. ex. |
| 18 | Forging | 0.052 | 0.25 | 0.11 | 33.18 | 5.21 | 0.17 | 0.042 | 0.008 | 0.045 | 0.022 | — | — | No | No | 0.62 | Comp. ex. |
| 18 | Casting | " | " | " | " | " | " | " | " | " | " | " | " | No | No | 0.71 | Comp. ex. |
| 19 | Forging | 0.007 | 0.08 | 0.18 | 32.81 | 2.91 | 0.12 | 0.039 | 0.009 | 0.033 | 0.012 | 1250 | 50 | Yes | — | −0.11 | Comp. ex. |
| 19 | Casting | " | " | " | " | " | " | " | " | " | " | " | " | Yes | — | −0.02 | Comp. ex. |
| 20 | Forging | 0.004 | 0.17 | 0.61 | 33.31 | 1.43 | 0.23 | 0.027 | 0.054 | 0.028 | 0.011 | 1150 | 50 | Yes | — | 0.17 | Comp. ex. |
| 20 | Casting | " | " | " | " | " | " | " | " | " | " | " | " | Yes | — | 0.26 | Comp. ex. |

The invention claimed is:

1. A low thermal expansion alloy consisting of, by mass %,

Co: 1.50 to 5.00%,

Ni satisfying $$[Co] \geq -4 \times [Ni] + 136 \text{ and}$$

$$[Co] \leq -4 \times [Ni] + 139$$

wherein [Ni] (mass %) is a content of Ni and [Co] (mass %) is a content of Co, and a balance of Fe and unavoidable impurities, wherein a mean thermal expansion coefficient at 0 to 30° C. is $0.5 \times 10^{-6}$/° C. or less and a martensite transformation temperature is −120° C. or less.

2. A low thermal expansion alloy, consisting of, by mass %,

Co: 1.50 to 5.00%,

Ni satisfying $$[Co] \geq -4 \times [Ni] + 136 \text{ and}$$

$$[Co] \leq -4 \times [Ni] + 139$$

wherein [Ni] (mass %) is a content of Ni and [Co] (mass %) is a content of Co, and one or more of:

C: 0 to 0.040%,

Si: 0 to 0.30%,

Al: 0 to 0.20%,

Mg: 0 to 0.100%,

Ca: 0 to 0.100%,

Ce: 0 to 0.100%, and

La: 0 to 0.100%, and a balance of Fe and unavoidable impurities, wherein:

a mean thermal expansion coefficient at 0 to 30° C. is $0.5\times10^{-6}$/° C. or less and a martensite transformation temperature is −120° C. or less.

3. The low thermal expansion alloy according to claim 1, wherein the mean thermal expansion coefficient at 0 to 30° C. is $-0.04\times10^{-6}$/° C. or less.

* * * * *